US010578009B2

(12) United States Patent
Böhme

(10) Patent No.: US 10,578,009 B2
(45) Date of Patent: Mar. 3, 2020

(54) TWO-STROKE INTERNAL COMBUSTION ENGINE

(71) Applicant: Joachim Böhme, Niederwiesa OT Lichtenwalde (DE)

(72) Inventor: Joachim Böhme, Niederwiesa OT Lichtenwalde (DE)

( * ) Notice: Subject to any disclaimer, the term of this patent is extended or adjusted under 35 U.S.C. 154(b) by 0 days.

(21) Appl. No.: 16/307,969

(22) PCT Filed: Apr. 28, 2017

(86) PCT No.: PCT/DE2017/000120
§ 371 (c)(1),
(2) Date: Dec. 7, 2018

(87) PCT Pub. No.: WO2017/190722
PCT Pub. Date: Nov. 9, 2017

(65) Prior Publication Data

US 2019/0145308 A1 May 16, 2019

(30) Foreign Application Priority Data

May 4, 2016 (DE) ..... 10 2016 005 538

(51) Int. Cl.
*F02B 25/04* (2006.01)
*F01L 5/06* (2006.01)
(Continued)

(52) U.S. Cl.
CPC ..... *F02B 25/20* (2013.01); *F01L 5/06* (2013.01); *F02B 25/04* (2013.01); *F02B 33/30* (2013.01); *F02B 2075/025* (2013.01)

(58) Field of Classification Search
CPC ..... F02B 25/04; F02B 25/06; F02B 25/02; F02B 25/20; F02B 25/24; F02B 2075/025; F01L 5/06
(Continued)

(56) References Cited

U.S. PATENT DOCUMENTS 1,001,506 A * 8/1911 Clement ..... F01L 5/06 123/314
1,014,270 A * 1/1912 Utz ..... F02B 19/1028 123/274
(Continued)

FOREIGN PATENT DOCUMENTS

DE 528407 6/1931
DE 528407 C * 6/1931 ..... F01L 5/06
(Continued)

OTHER PUBLICATIONS

English Machine Translation Provided by ESPACENET of JP-04303121-A (Year: 2019).*

*Primary Examiner* — Jacob M Amick
*Assistant Examiner* — Michael A Kessler
(74) *Attorney, Agent, or Firm* — Smartpat PLC

(57) ABSTRACT

The invention relates to a two-stroke internal combustion engine, in particular for a motor vehicle, with direct fuel injection, comprising at least one working cylinder (1) which comprises a bushing and in which a piston (6) can be moved in an oscillating manner; at least one outlet channel (2) which opens into the working cylinder (1) above the upper dead center of the piston (6); at least two inlet openings (5) which are distributed over the circumference of the bushing and which open into the working cylinder (1) above the lower dead center of the piston (6) such that a uniflow scavenging process of the working cylinder (1) is produced during the operation of the two-stroke internal combustion engine; and a slider which releases and closes the inlet openings (5), whereby the slider is designed as a tube slider (4) which surrounds the bushing of the working cylinder (1) and which comprises a closed casing. The slider releases or closes the inlet openings (5) in an oscillating
(Continued)

manner in the longitudinal direction of the bushing during the charge cycle.

6 Claims, 2 Drawing Sheets

(51) Int. Cl.
*F02B 75/02* (2006.01)
*F02B 25/20* (2006.01)
*F02B 33/30* (2006.01)

(58) Field of Classification Search
USPC ..... 123/65 VS, 65 VA, 74 D
See application file for complete search history.

(56) References Cited

U.S. PATENT DOCUMENTS

| | | | | | |
|---|---|---|---|---|---|
| 2,018,848 | A | * | 10/1935 | Gruebler | F02B 1/00 123/65 BA |
| 2,229,709 | A | | 1/1941 | Honore | |
| 3,815,566 | A | | 6/1974 | Staggs | |
| 5,063,881 | A | | 11/1991 | Kawamura | |
| 5,113,805 | A | | 5/1992 | Kawamura | |
| 5,899,178 | A | | 5/1999 | Green | |
| 9,429,067 | B2 | * | 8/2016 | Yamada | F02B 25/04 |

FOREIGN PATENT DOCUMENTS

| | | | | | |
|---|---|---|---|---|---|
| DE | 858046 | | | 12/1952 | |
| DE | 858046 | C | * | 12/1952 | F01L 5/06 |
| DE | 865237 | | | 2/1953 | |
| DE | 69010865 | | | 11/1994 | |
| DE | 19700412 | A1 | | 7/1997 | |
| DE | 4022705 | C2 | | 11/1999 | |
| DE | 69731984 | | | 1/2005 | |
| FR | 443217 | A | | 9/1912 | |
| GB | 190900385 | A | | 1/1910 | |
| GB | 191205108 | A | | 2/1912 | |
| JP | S5956310 | A | | 3/1984 | |
| JP | S59192824 | A | | 11/1984 | |
| JP | 04303121 | A | * | 10/1992 | |
| JP | 3074763 | B2 | | 8/2000 | |

* cited by examiner

TWO-STROKE INTERNAL COMBUSTION ENGINE

TECHNICAL FIELD

The disclosure relates to a two-stroke direct-injection internal combustion engine with uniflow scavenging, in particular for a motor vehicle.

BACKGROUND

Uniflow scavenging is one of the generally known types of scavenging in two-stroke engines. In uniflow scavenging, gas flows in only one direction in the cylinder. Outlet and inlet ports are at opposite ends of the cylinder chamber. The fresh gas always pushes the exhaust gas in the same direction from the inlet to the outlet. Generally, inlet slots in the bottom dead center and one or more outlet valves in the top dead center are used for the gas exchange. A scavenging pump introduces pressurized fresh air through the inlet slots into the cylinder. When the outlet valve(s) is/are open, the exhaust gas from the cylinder has been previously driven out through the pressure gradient.

An internal combustion engine having variable cycles is known from DE 690 52 10 865, which operates alternately in the two-stroke process and in the four-stroke process, depending on the rotation speed and load of the engine. The internal combustion engine comprises a cylinder which is provided with a first inlet port and an outlet port which are defined at the upper region of the cylinder and with a second inlet port which is defined at the lower region of the cylinder; a cylindrical cylinder liner which is arranged in the cylinder and is provided with a third inlet port which is defined in the lower region of the cylinder liner; a sleeve which is arranged rotatable about the cylinder liner to selectively open and close the third inlet port, wherein the sleeve is provided with an integrally formed permanent magnet; rotation means for rotating the sleeve under the influence of electromagnetic forces which act on the permanent magnet; inlet port opening and closing means for selectively opening and closing the first inlet port at the upper region of the cylinder; outlet port opening and closing means for selectively opening and closing the exhaust gas duct in the upper region of the cylinder; over-comp action means for providing pressurized air to the first inlet port and to the second inlet port, and cycle mode selecting means for, on the one hand, setting the rotation means into motion to rotate the sleeve to open the third inlet port in coordination with the second inlet port, and to operate the exhaust gas duct opening and closing means, and on the other hand, to set the rotation means into motion to rotate the sleeve to close the third inlet port and to operate the inlet port and outlet port opening and closing means to operate the engine in four-stroke mode.

This means that when the internal combustion engine is operated in four-stroke mode, the gas exchange is controlled via the outlet port and inlet port opening and closing means arranged in the upper region of the cylinder. When the internal combustion engine is operated in two-stroke mode, the gas exchange takes place via the outlet opening and closing means arranged in the upper region of the cylinder and via the inlet ports arranged in the lower region in the cylinder, which in this case are released by turning the sleeve. The inlet ports in the upper region of the cylinder remain closed.

In the two-cycle mode, the gas exchange takes place as a pure uniflow scavenging. The sleeve does not control the actual gas exchange here. The opening and closing of the inlet ports takes place through the piston upper edge.

A control for a two-stroke internal combustion engine with uniflow scavenging is known from DE 865 237 B, which is achieved by providing outlet bores in the bottom of the working cylinder, which outlet bores alternately release and block openings of an exhaust pipe plate during the rotational movement of the working cylinder, and by providing inlet slots at the inner end of the cylinder, which inlet slots alternately release and re-block openings of an inlet ring enclosing the cylinder, which inlet ring is adjustably arranged on the crankcase for the purpose of regulating the inlet timing.

The charge cycle is performed by the rotating cylinder, by which the outlet bores and inlet slots are released and blocked. The inlet ring is adjustably arranged on the crankcase to regulate the inlet timing.

DE 197 00 412 A1 describes a two-stroke diesel engine with uniflow scavenging, with inlet slider and outlet valves controlled by the working piston. The inlet slider is mounted in the bore of the cylinder and the cylinder cover, with its conical surface of at least three tie rods, which are mounted in the cylinder surface, is pressed with springs in the axial direction of the cylinder against conical surfaces of the cylinder, and when displacing the piston just before reaching the bottom dead center, is entrained by this, so that an annular air gap is formed, and at the same time the three outlet valves in the cylinder head open from the three tie rods over the spring carrier. The cylinder bore and inlet slider bore have the same diameter. During the downward movement of the piston (working stroke), the piston ring surface hits against the inner ring surface of the inlet slider after about 9/10 of the piston stroke and opens the inlet cross-section. The spring carrier with the springs and the spring sleeve are thereby tensioned. During upward movement of the piston, the inlet slider is pulled over the tie rods by means of the tensioned springs with its conical surface against the conical surface of the cylinder and the inlet cross-section is closed.

Two-stroke engines having uniflow scavenging, having scavenging ports or charging slots in the cylinder wall and exhaust valves in the cylinder lids, are well known. They are usually designed as slow-running large engines and have good efficiencies. However, they have a significant disadvantage due to their long piston and cylinder and therefore have complex dimensions and large weights.

In the medium-speed two-stroke engines, pistons with a very long piston skirt, on the lower edge of which one or two piston rings are arranged, are used to prevent the scavenging air from being able to penetrate freely into the crankcase space. This also has an adverse effect with respect to the installation size of the engine and on the design effort.

SUMMARY

The present disclosure is based on the object of providing a two-stroke internal combustion engine having uniflow scavenging, which can be built with fewer cylinders or larger cylinder volume than known automobile engines of the same power. The improved engine uses the better efficiency of the two-stroke method to reduce the weight and size of the internal combustion engine.

The improved two-stroke internal combustion engine has a cylinder with a cylinder liner. A piston is movable in an oscillating manner within the cylinder. At least one outlet port is arranged in the cylinder above a top dead center position of the piston. At least two inlet openings are spatially separated from one another around a circumference of the cylinder liner and arranged above a bottom dead center position of the piston. A slide valve is formed by a sleeve around the cylinder liner which oscillates in longitudinal direction of the cylinder and releases and blocks the at least two inlet openings during a charge cycle of the engine. This provides uniflow scavenging of the cylinder during operation of the engine. The two-stroke internal combustion engine can operate both according to the diesel method and according to the Otto method, in which case a spark plug is additionally provided.

The two-stroke internal combustion engine can include one or more cylinders and a crankcase. At least one outlet port is provided above the top dead center position of the piston, and at least two inlet openings are provided above the bottom dead center position of the piston. The release or closing of the inlet openings and thus the supply of the scavenging force in the working cylinder is affected by a sleeve having a closed shell arranged around the cylinder liner of the working cylinder. The sleeve moves in an oscillating manner in the longitudinal direction of the working cylinder along an outer wall of the cylinder liner. At least one annular sealing element is arranged for sealing a gap between an inner wall of the sleeve and an outer wall of the cylinder liner. The annular sealing elements are preferably formed in the form of piston rings and provided in the direction of the crankcase below the inlet openings.

The oscillating movement of the sleeve during the charge cycle on the outer wall of the cylinder liner is affected by a control device. This can either be formed as a desmodromic control device in the form of a cam controller having a lever engaging on the outer circumference of the sleeve, which lever is preferably designed forked, as an electromagnetic, or as a hydraulic control device.

In addition to the sleeve, a swirl ring can be arranged on its outer wall spaced thereto. The upstream swirl ring has flow channels with different tangential inflow angles, which make it possible to influence the scavenging process in the working cylinder. The swirl ring ensures that the air flow through the inlet opening flows in a direction that runs tangential to the circumference of the working cylinder. Such a non-turbulent flow running in one direction supplies the working cylinder with fresh air via each flushing opening during the scavenging process.

The two-stroke internal combustion engine may be formed in monobloc construction. The working cylinders may be formed with a monobloc cylinder head.

In that case, the benefits are an optimized cooling in the region of top dead center, the elimination of the cylinder head gasket and no warpage because the cylinder head bolts are eliminated.

Overall, the advantages of the two-stroke internal combustion engine having uniflow scavenging lie in an optimal scavenging efficiency compared to the known scavenging modes such as reverse scavenging, cross-flow scavenging.

The use of four outlet valves results in lower throttle losses during discharge of the exhaust gases and thus a lesser amount of residual gas in the working cylinder. The use of the four-valve technology for the outlet in conjunction with the uniflow scavenging inlet openings in the region of the bottom dead center position of the piston allow for asymmetrical control diagrams for the charge cycle, wherein the blow-down generates the necessary scavenging gradient.

The distribution of the inlet openings over the cylinder circumference allows large time and geometric cross-sections for the charge cycle. Due to the fact that the inlet openings are in the so-called "cold" region, the coking tendency is reduced compared to inlet regions lying in the cylinder head.

A further advantage of the two-stroke internal combustion engine with respect to a four-stroke internal combustion engine is that at the same load (medium pressure), the number of cylinders can be reduced, which is associated with a reduction in engine weight and the cost of production.

The internal combustion engine has a much better response due to smaller driving gear masses.

The internal combustion engine can start up immediately through the use of devices for charging, e.g., exhaust gas turbocharger and an electrically switchable compressor, in particular for the starting region of the internal combustion engine. A desired higher engine power can be achieved arbitrarily by connecting the electric compressor, whereby an additional second exhaust gas turbocharger can be omitted.

The advantages of the sleeve with respect to other slide valves arranged at a distance from the inlet openings, such as roller valves, are that the sleeve is arranged to slide directly on the outer wall of the cylinder liner, resulting in a low dead space. The sleeve follows the piston movement, covers the piston rings and at the same time is a sealing element that seals the scavenging air space to the crankcase space, and thus influences the height of the internal combustion engine.

A further advantage in the use of a sleeve is that the piston skirt can be designed substantially shorter, similar to pistons for four-stroke internal combustion engines, since the piston skirt no longer needs to cover the inlet openings with its sealing rings.

BRIEF DESCRIPTION OF THE DRAWINGS

An example embodiment will be explained by reference to the following drawings.

DETAILED DESCRIPTION

Figure 1:
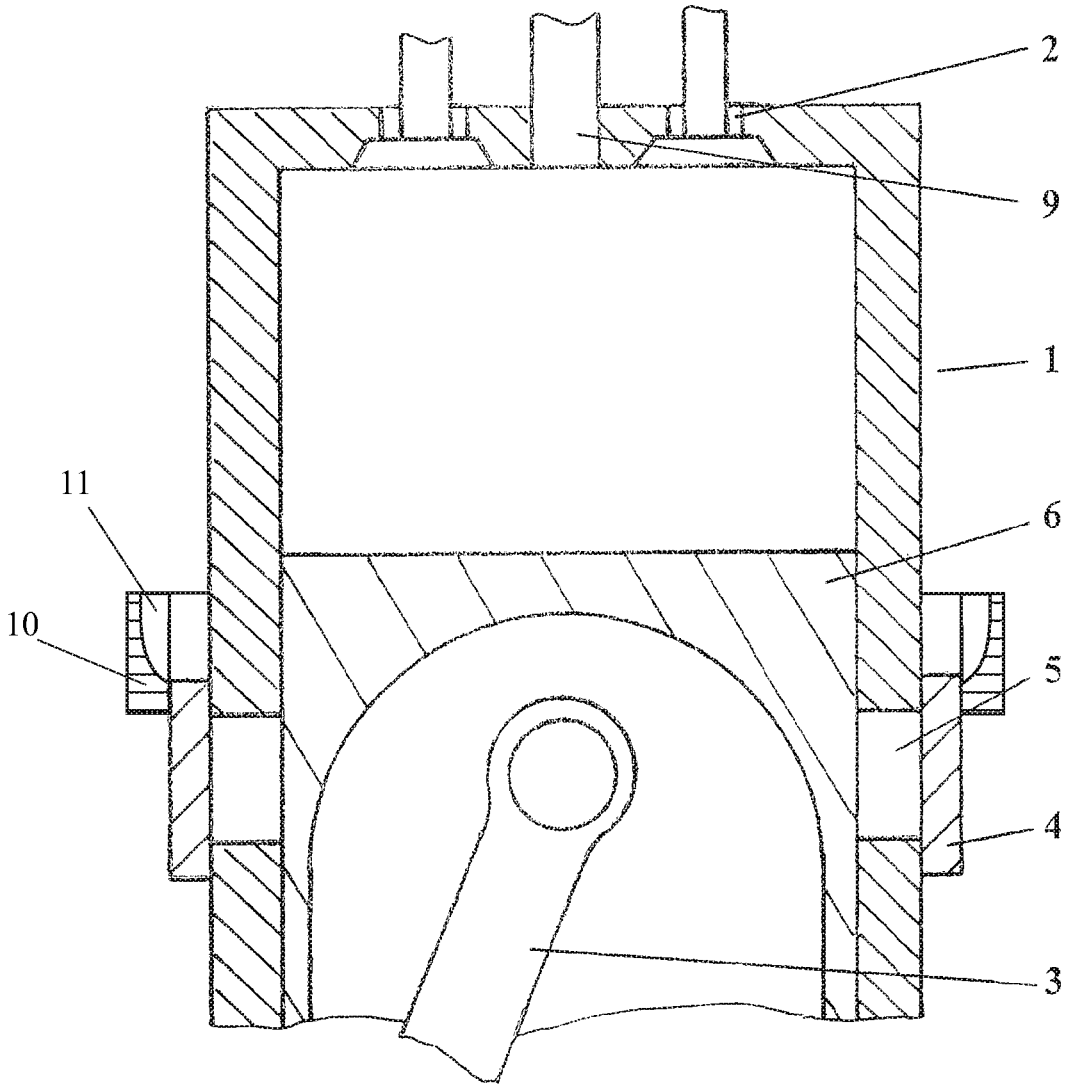
FIG. 1 is a schematic representation of the working cylinder of a two-stroke internal combustion engine.

FIG. 1 shows a schematic representation of the working cylinder 1 of a two-stroke internal combustion engine. For ease of understanding, reference will be made below only to one working cylinder and the working cylinder 1 shown as a cylinder liner in blind-hole design.

The two-stroke internal combustion engine—hereinafter referred to as two-stroke diesel engine—consists essentially of the crankcase having the crankshaft, a working cylinder 1 having injection nozzle 9 arranged in the region of top dead center and four valve-controlled outlet ports 2, a piston 6 movable in an oscillating manner in the working cylinder 1 and connected to the crankshaft via a connecting rod 3.

The working cylinder 1 having a blind-hole-shaped cylinder liner has inlet openings 5 distributed over the circumference in the region of bottom dead center. A sleeve 4 having a closed shell is arranged on the outer wall of the cylinder liner, which sleeve blocks or releases the inlet openings 5 in an oscillating manner.

Figure 2:
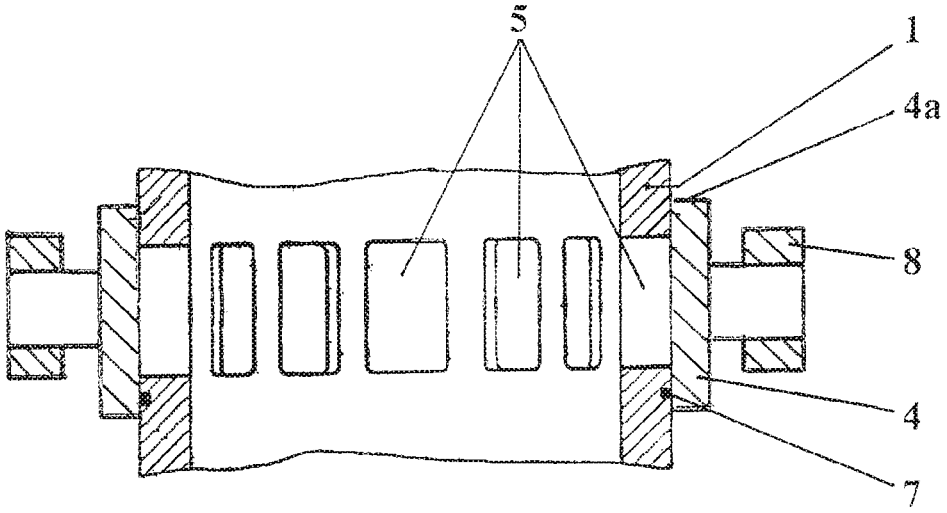
FIG. 2 shows an inlet region with a sleeve.

The arrangement of the inlet openings 5 in the region of bottom dead center in connection with the sleeve 4 is shown in FIG. 2.

The inlet openings 5 are arranged at a uniform distance from each other distributed over the circumference of the cylinder liner. Sealing rings 7 are held above and below the inlet openings 5 in circumferential grooves on the outer wall of the cylinder liner of the working cylinder 1. These seal the gap between the cylinder liner of the working cylinder 1 and sleeve 4.

The sleeve 4 has a closed shell and thus controls the release or closing of the inlet openings 5 through its oscillating movement by means of the control edge 4 *a*.

This eliminates the actual control of the inlet openings 5 by the top edge of the piston 6 and the seal in the direction of the crankcase by a substantially longer piston skirt and the corresponding piston ring.

In the present example, the control of the sleeve 4 with the aid of a desmodromic control unit in the form of a cam controller is performed with a rotatably engaging and fork-shaped lever 8 on the outer circumference of the sleeve 4.

The illustrated two-stroke diesel engine operates as follows:

After completion of the compression stroke and the injection of the fuel, the fuel-air mixture ignites. The outlet ports 2 are closed, the inlet openings 5 are also closed by means of the sleeve 4. In the downward movement of the piston 6 (power stroke), the outlet ports 2 partially open at a specified time, and it starts the blow-down. Upon reaching the inlet openings through the upper edge of the piston 6, the sleeve 4 starts by moving in the same direction as the piston 6 to release the inlet slots 5 with its control edge 4 *a* and the fresh air enters via the inlet slots in the cylinder chamber. The outlet ports 2 are completely open at the same time. The overpressure of the fresh air is generated by an exhaust gas turbocharger (not shown in detail) and an electrically driven compressor.

For proper scavenging, the scavenging air purposefully enters into the cylinder tangentially through flow channels 11 of a swirl ring 10 and forms a swirling column standing on the piston base that increases by helically rising in height, forms a plug and displaces the combustion gases. These combustion gases are driven out through the fully open outlet ports.

The outlet ports 2 and the inlet openings 5 are fully opened in the piston position bottom dead center.

At the same time with the movement of the piston 6, the sleeve 4 is moved via the desmodromic control on the outer wall of the cylinder liner of the working cylinder 1 in the same direction and closes the inlet openings 5.

The fresh air is further compressed in the further course of the upward movement of the piston 6. Shortly before reaching the top dead center, the fuel is injected via the injection nozzle 9 and ignited. The process begins again.

In the case of starting up the two-stroke internal combustion engine, the generation of the overpressure of the fresh air for scavenging is performed by means of a switchable electric compressor which is switched off again after start-up of the exhaust gas turbocharger.

The switchable electric compressor, however, can also work simultaneously with the exhaust gas turbocharger.

LIST OF REFERENCE NUMBERS

1 working cylinder
2 outlet port
3 connecting rod
4 sleeve
4*a* control edge
5 inlet openings
6 piston
7 annular sealing element
8 lever
9 injection nozzle

The invention claimed is:

1. A two-stroke direct-injection internal combustion engine, comprising: a cylinder with a cylinder liner; a piston movable in an oscillating manner within the cylinder; at least one outlet port arranged in the cylinder above a top dead center position of the piston; at least two inlet openings spatially separated from one another around a circumference of the cylinder liner and arranged above a bottom dead center position of the piston; a slide valve formed by a sleeve around the cylinder liner which oscillates in a longitudinal direction of the cylinder and releases and blocks the at least two inlet openings during a charge cycle of the engine, thereby providing uniflow scavenging of the cylinder during operation of the engine, an annular sealing element arranged in a gap between an inner wall of the sleeve and an outer wall of the cylinder liner; and a swirl ring arranged on and spaced at a distance from an outside of the sleeve.

2. The two-stroke direct-injection internal combustion engine according to claim 1, wherein the oscillating movement of the sleeve along an outer wall of the cylinder liner is affected by a desmodronic control device in form of a cam controller with a lever engaging an outer circumference of the sleeve.

3. The two-stroke direct-injection internal combustion engine according to claim 1, wherein the oscillating movement of the sleeve along an outer wall of the cylinder liner is affected by an electromagnetic control device.

4. The two-stroke direct-injection internal combustion engine according to claim 1, wherein the oscillating movement of the sleeve along an outer wall of the cylinder liner is affected by a hydraulic control device.

5. The two-stroke direct-injection internal combustion engine according to claim 1, wherein the cylinder is formed with a monobloc cylinder head.

6. The two-stroke direct-injection internal combustion engine according to claim 1, wherein the swirl ring has flow channels with different tangential inflow angles.

* * * * *